US010912697B2

(12) United States Patent
Staudinger

(10) Patent No.: US 10,912,697 B2
(45) Date of Patent: Feb. 9, 2021

(54) OPERATING TABLES, RELATED DEVICES, AND RELATED METHODS

(71) Applicant: MAQUET GMBH, Rastatt (DE)

(72) Inventor: Martin Staudinger, Ettlingen (DE)

(73) Assignee: MAQUET GMBH, Rastatt (DE)

( * ) Notice: Subject to any disclaimer, the term of this patent is extended or adjusted under 35 U.S.C. 154(b) by 761 days.

(21) Appl. No.: 15/663,319

(22) Filed: Jul. 28, 2017

(65) Prior Publication Data

US 2017/0325758 A1 Nov. 16, 2017

Related U.S. Application Data

(63) Continuation-in-part of application No. PCT/EP2016/052044, filed on Feb. 1, 2016.

(30) Foreign Application Priority Data

Feb. 5, 2015 (DE) ..... 10 2015 101 657

(51) Int. Cl.

| | |
|---|---|
| ***A61G 13/08*** | (2006.01) |
| ***A61G 13/04*** | (2006.01) |
| ***A61G 13/02*** | (2006.01) |
| ***A61G 13/10*** | (2006.01) |
| ***A61G 13/12*** | (2006.01) |

(52) U.S. Cl.

CPC ..... *A61G 13/08* (2013.01); *A61G 13/02* (2013.01); *A61G 13/04* (2013.01); *A61G 13/10* (2013.01); *A61G 13/129* (2013.01)

(58) Field of Classification Search

CPC .... A61G 13/0036; A61G 13/02; A61G 13/04; A61G 13/08; A61G 15/02; A61G 13/10; A61G 13/129

See application file for complete search history.

(56) References Cited

U.S. PATENT DOCUMENTS 2,217,783 A * 10/1940 Bell ..... A61G 13/02 5/614
2,520,455 A * 8/1950 Clachko ..... A61G 13/02 5/614

(Continued)

FOREIGN PATENT DOCUMENTS

CN 1552297 A 12/2004
CN 1973801 A 6/2007

(Continued)

OTHER PUBLICATIONS

Chinese Office Action and Chinese Search Report dated Mar. 15, 2019 during the prosecution of corresponding Chinese Patent Application No. 201680008739.4, 5 pages.

(Continued)

*Primary Examiner* — Nicholas F Polito

(57) ABSTRACT

An operating table includes a column, a hydraulic unit positioned in the column, and a patient supporting surface connected to the column. The operating table also includes a first pair of hydraulic cylinders for adjusting a portion of the supporting surface relative to a remainder of the supporting surface, and the supporting surface is hydraulically connected to the hydraulic unit only by a single supply line and a single return line extending between the supporting surface and the hydraulic unit.

17 Claims, 8 Drawing Sheets

(56) References Cited

U.S. PATENT DOCUMENTS

| | | | | | |
|---|---|---|---|---|---|
| 3,206,188 | A * | 9/1965 | Douglass | A61G 13/02 | 5/614 |
| 3,896,704 | A | 7/1975 | Barud et al. | | |
| 3,982,741 | A * | 9/1976 | Mitchell | A61G 7/015 | 5/614 |
| 4,012,031 | A * | 3/1977 | Mitchell | F15B 13/01 | 5/614 |
| 6,038,718 | A | 3/2000 | Pennington et al. | | |
| 2002/0144349 | A1 * | 10/2002 | Blyshak | F15B 15/149 | 5/614 |
| 2011/0005217 | A1 | 1/2011 | Liang | | |

FOREIGN PATENT DOCUMENTS

| | | | | |
|---|---|---|---|---|
| CN | 2912529 | Y | 6/2007 | |
| CN | 2930684 | Y | 8/2007 | |
| CN | 202211825 | U | 5/2012 | |
| CN | 203436510 | U | 2/2014 | |
| DE | 2301288 | A1 | 10/1973 | |
| DE | 3704332 | A1 | 7/1988 | |
| DE | 10321319 | A1 * | 12/2004 | A46B 91/02 |
| DE | 102005050856.1 | A1 | 4/2007 | |
| EP | 0139118 | A1 | 5/1985 | |
| GB | 990737 | A | 4/1965 | |
| WO | 02058615 | A1 | 8/2002 | |

OTHER PUBLICATIONS

Japanese Office Action (with English translation) dated Nov. 5, 2019 during the prosecution of corresponding Japanese Patent Application No. 2017-539003, 9 pages.

Translated international Search Report (completed Apr. 29, 2016—dated May 9, 2016) which issued for corresponding international application PCT/EP2016/052044, 3 pages.

* cited by examiner

OPERATING TABLES, RELATED DEVICES, AND RELATED METHODS

CROSS-REFERENCE TO RELATED APPLICATIONS

The present application is a continuation-in-part filed under 35 U.S.C. § 111(a), and claims the benefit under 35 U.S.C. §§ 365(c) and 371 of PCT International Application No. PCT/EP2016/052044, filed on Feb. 1, 2016, which designates the United States of America, and claims benefit of German Patent Application No. 10 2015 101 657.5, filed on Feb. 5, 2015 The disclosure of each of these applications is incorporated by reference herein in its entirety.

TECHNICAL FIELD

The present disclosure relates to an operating table having a column, a supporting surface, and a hydraulic unit.

BACKGROUND

Conventional operating tables comprising a column, a supporting surface, and a hydraulic unit arranged in a base of the operating table include a controller, arranged on the column, for controlling hydraulic cylinders located in the supporting surface. Typically, four hydraulic cylinders are used to adjust various supporting surface segments of the supporting surface, which has a leg plate and a back plate. To supply the hydraulic cylinders with hydraulic pressure, known operating tables require two hoses per hydraulic cylinder. Thus, with the known operating table, typically eight hoses run from the controller arranged on the column to the hydraulic cylinders located in the supporting surface. Furthermore, with the known operating table, the controller arranged on the column is hydraulically connected to the hydraulic unit arranged in the base of the operating table.

It is a disadvantage of the known operating table that the eight hoses that run from the controller arranged on the column to the hydraulic cylinders located in the supporting surface have a relatively large cross-sectional area and, thus, require a relatively large amount of space in the column. It is a further disadvantage of the known operating table that, when the supporting surface is displaced longitudinally in relation to the column, all eight hoses, which extend partially within the column and partially within the supporting surface, must be carried along with the supporting surface, which is relatively complex and costly.

BRIEF SUMMARY

In one exemplary aspect of the disclosure, an operating table includes a column, a hydraulic unit positioned in the column, a patient supporting surface connected to the column, and a first pair of hydraulic cylinders for adjusting a portion of the supporting surface relative to a remainder of the supporting surface. The supporting surface is hydraulically connected to the hydraulic unit only by a single supply line and a single return line extending between the supporting surface and the hydraulic unit.

In another exemplary aspect of the disclosure, an operating table includes a column, a hydraulic unit positioned at least partially within the column, and a supporting surface attached to the column. The supporting surface includes a first segment, a second segment, and a third segment to which the first segment and the second segment are pivotably coupled, a first pair of hydraulic cylinders for adjusting the first segment relative to the third segment, a second pair of hydraulic cylinders for adjusting the second segment relative to the third segment, a first valve unit in fluid communication with the hydraulic unit and the first pair of hydraulic cylinders, and a second valve unit in fluid communication with the hydraulic unit and the second pair of hydraulic cylinders.

In yet another exemplary aspect of the disclosure, a modular operating table system includes a supporting surface module including a patient supporting surface having at least two supporting segments and valves for connection to a hydraulic system to implement pivoting of the at least two segments of the supporting surface relative to one another, and a column module comprising a hydraulic system and connections for a single supply line and a single return line configured to be connected to a valve unit in the supporting surface module. The column module is configured to implement lifting, tilting and inclining actions of the supporting surface.

Additional features and advantages of the present disclosure will be apparent from the following description, in which the features of the disclosure are explained in reference to exemplary embodiments, in conjunction with the accompanying figures.

It is to be understood that both the foregoing general description and the following detailed description are exemplary and explanatory only and are not restrictive of the present disclosure and claims.

DETAILED DESCRIPTION

Figure 1A:
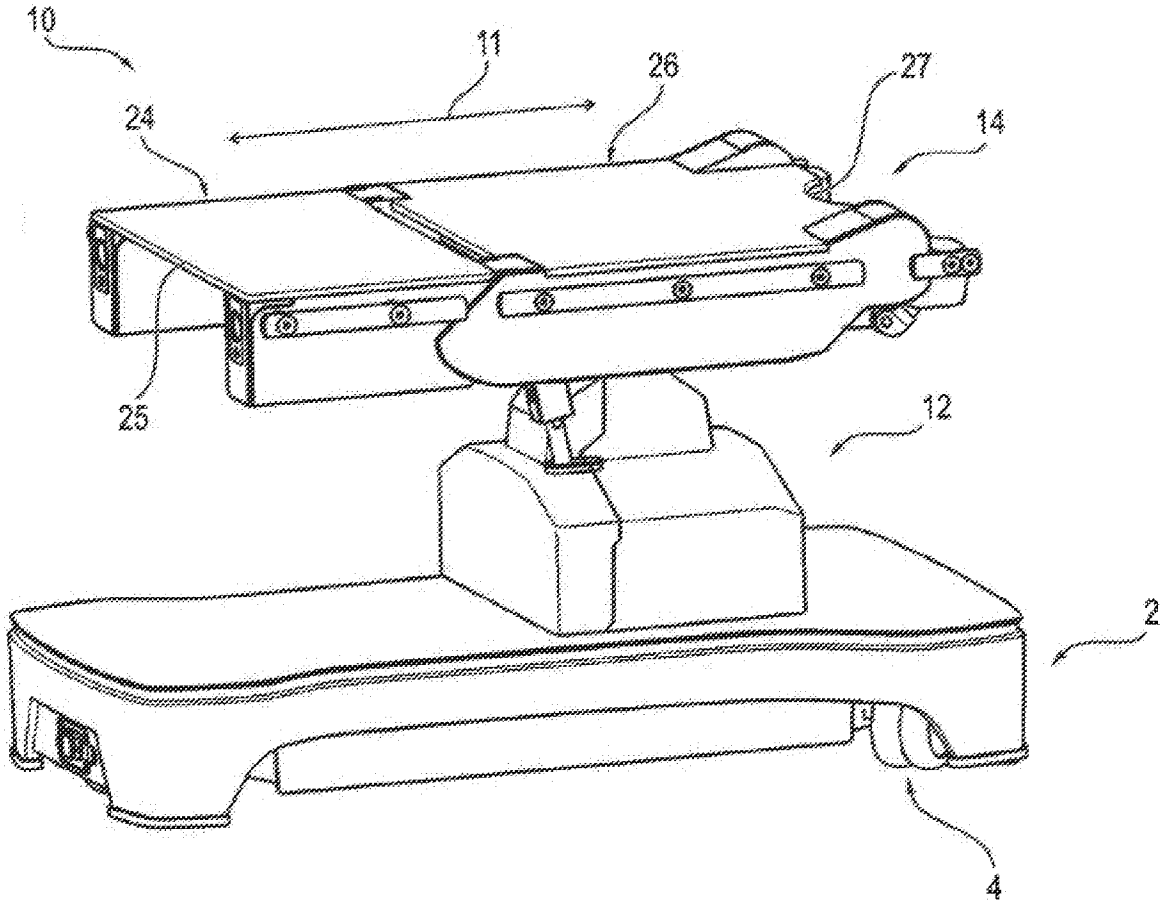
FIG. 1A shows a perspective view of an operating table having a column and a supporting surface connected to the column and comprising a back plate and a base plate, in accordance with an exemplary embodiment of the disclosure.

A simple and space-saving handling of hydraulic hoses is achieved with an operating table having the features of the present disclosure. A first valve unit for controlling a first pair of hydraulic cylinders and a second valve unit for controlling a second pair of hydraulic cylinders are integrated into the supporting surface of the operating table. The first valve unit and the second valve unit are hydraulically connected, by means of only one supply line and one return line, to a hydraulic unit arranged in the column. Thus, only one supply line and one return line, or only two hydraulic hoses, run between the hydraulic unit arranged in the column and the valve units integrated into the supporting surface. Moreover, when the supporting surface is displaced longitudinally relative to the column, only the supply line and the return line, which are hydraulically connected to the hydraulic unit, i.e. only two hydraulic hoses, must be carried along with it. As a result, space is saved in the column, while at the same time simplifying the carrying along of hydraulic hoses when the supporting surface is displaced longitudinally relative to the column. This enables a simple and space-saving handling of the hydraulic hoses in the operating table.

During an inclining and/or tilting movement of the supporting surface, all the components that are integrated into the supporting surface move along with it. The components that are integrated into the supporting surface may include a first pair of hydraulic cylinders for adjusting a first supporting surface segment of the supporting surface, a second pair of hydraulic cylinders for adjusting a second supporting surface segment of the supporting surface, a first valve unit for controlling the first pair of hydraulic cylinders and a second valve unit for controlling the second pair of hydraulic cylinders, along with hydraulic lines that run from the valve units to the hydraulic cylinders. The components that are integrated into the supporting surface also may include check valves that are integrated into the valve units.

In some embodiments, the supporting surface is displaceable relative to the column along a longitudinal displacement path in a longitudinal direction of the supporting surface. For this purpose, the supply line and return line that are hydraulically connected to the hydraulic unit each include a hose, which is installed at least partially in a compensation loop for bridging the longitudinal displacement path in an area of the column that faces a longitudinal side of the supporting surface. In this way, when the supporting surface is displaced longitudinally in relation to the column, the longitudinal displacement path can be compensated for without over-stretching or damaging the hoses of the supply line and the return line that are hydraulically connected to the hydraulic unit.

The first pair of hydraulic cylinders and/or the second pair of hydraulic cylinders may form a hydraulic cylinder system having a first hydraulic cylinder and a second hydraulic cylinder for adjusting a supporting surface segment of the supporting surface of the operating table. In accordance with one exemplary embodiment of the present disclosure, the first hydraulic cylinder and the second hydraulic cylinder are double-acting hydraulic cylinders with a first piston movement direction and a second piston movement direction. In addition, a leading active surface of the first hydraulic cylinder in the first piston movement direction, and a leading active surface of the second hydraulic cylinder in the second piston movement direction are the same size. Further, a cylinder chamber of the first hydraulic cylinder, which adjoins the leading active surface of the first hydraulic cylinder in the first piston movement direction, and a cylinder chamber of the second hydraulic cylinder, which adjoins the leading active surface of the second hydraulic cylinder in the second piston movement direction, are connected to one another via a connecting line. In this way, a hydraulic cylinder system having two double-acting hydraulic cylinders can be realized, with which a supporting surface segment of the supporting surface can be adjusted in a controlled manner. Advantageously, the parallel operation or clocking of the two double-acting hydraulic cylinders can be achieved using this hydraulic cylinder system.

In some embodiments, the operating table may include a third valve unit, embodied as a synchronizing valve unit for synchronizing the clocking of the first hydraulic cylinder and the second hydraulic cylinder. In a synchronized operating state, the connecting line can be connected via the third valve unit either to a pressure line connected to the hydraulic unit or to a return flow line connected to the hydraulic unit. In a synchronized operating state, the clocking of the two double-acting hydraulic cylinders can thereby be synchronized, so that in a clocked operating state, the parallel operation or the clocking of the two double-acting hydraulic cylinders is achieved. During parallel operation, the movement of the two double-acting hydraulic cylinders is always identical, i.e., they have the same piston movement direction and the same piston movement speed.

In a clocked operating state, the piston movements of the first hydraulic cylinder and the second hydraulic cylinder may be synchronous. At the same time, in the clocked operating state the third valve unit is closed. When the third valve unit is closed, the connecting line is not connected to either the pressure line that is connected to the hydraulic unit or to the return flow line that is connected to the hydraulic unit. In the clocked operating state, the third valve unit has no influence on the double-acting hydraulic cylinders of the hydraulic cylinder system, which are operating in parallel. The connecting line may include a line section that is connected to the third valve unit. In the line section that is connected to the third valve unit, a check valve is located, which can be hydraulically released in the direction from the third valve unit to the respective hydraulic cylinder system. The check valve can therefore also be opened in the shut-off direction by pressurization with hydraulic fluid pressure, allowing hydraulic fluid to flow through. Conversely, hydraulic fluid is always able to flow through the check valve in the direction opposite the shut-off (i.e., locked) direction.

In various exemplary embodiments, the first pair of hydraulic cylinders may comprise a first hydraulic cylinder and a second hydraulic cylinder, and the second pair of hydraulic cylinders may comprise a third hydraulic cylinder and a fourth hydraulic cylinder. In addition, the supporting surface has a first side rail and a second side rail opposite the first side rail. Additionally, the first hydraulic cylinder and the third hydraulic cylinder are arranged in the first side rail, and the second hydraulic cylinder and the fourth hydraulic cylinder are arranged in the second side rail. Further, the first valve unit is arranged in the first side rail and the second valve unit is arranged in the second side rail. Furthermore, the first hydraulic cylinder and the second hydraulic cylinder are each connected via one or two hoses to the first valve unit, and the third hydraulic cylinder and the fourth hydraulic cylinder are each connected via one or two hoses to the second valve unit. A configuration can thereby be achieved in which the valve units arranged in the two opposing side rails of the supporting surface are each connected via two or four hydraulic hoses to either the hydraulic cylinders of the first pair or the hydraulic cylinders of the second pair. In such a configuration, one or two hydraulic hoses extend in each case between the first side rail and the second opposing side rail of the supporting surface. If the hydraulic cylinders of the first pair and the hydraulic cylinders of the second pair are integrated into the supporting surface, a total of four or eight hoses are located in the supporting surface between the valve units and the hydraulic cylinders. These four or eight hoses do not require any space in the column and can be simply carried along when the supporting surface is displaced longitudinally in relation to the column.

Between the first side rail and the second side rail, a cross connection (e.g., a cross member) may be provided to accommodate those hoses that extend between the first side rail and the second side rail. The cross connection is fixedly connected to the first side rail and the second side rail. The hydraulic hoses that extend between the two opposing side rails can thereby be held securely in the cross connection and can be easily carried along when the supporting surface is displaced longitudinally in relation to the column. The hydraulic hoses that are carried along always maintain the same position in relation to the supporting surface.

The first pair of hydraulic cylinders may comprise a first hydraulic cylinder and a second hydraulic cylinder, and the second pair of hydraulic cylinders may comprise a third hydraulic cylinder and a fourth hydraulic cylinder, the first hydraulic cylinder and the second hydraulic cylinder each being connected via one or two hydraulic lines to the first valve unit, and the third hydraulic cylinder and the fourth hydraulic cylinder each being connected via one or two hydraulic lines to the second valve unit. In accordance with the present teachings, a check valve is arranged in each valve unit, and can be released hydraulically in the direction from the first valve unit or the second valve unit to the respective hydraulic cylinder. Thus, a double-releasable check valve system can be provided for each of the pairs of hydraulic cylinders, enabling a more reliable operation of the hydraulic cylinders of each pair.

The column may be arranged on a base of the operating table, with the hydraulic unit arranged in the column without extending into the area of the base. A full integration of the hydraulic unit into the column can thereby be achieved. Because the hydraulic unit does not extend into the area of the base, the height of the base can be reduced.

In accordance with one aspect of the present disclosure, the operating table may comprise a hydraulic unit integrated into the column for generating an inclining and/or tilting movement of the supporting surface. The operating table can further comprise a hydraulic unit integrated into the base of the operating table for raising or lowering the operating table. The hydraulic unit integrated into the column and the hydraulic unit integrated into the base of the operating table are hydraulically connected to the hydraulic unit only via a supply line and a return line. A modular operating table system can thereby be achieved, in which each module (supporting surface, column and base) has its own hydraulic valve and associated hydraulic cylinders. The hydraulic units of the various modules of the modular operating table system can be operated independently of one another. Since the hydraulic units can be operated independently of one another, individual hydraulic units for specific functions of the operating table system can be eliminated without the entire operating table system having to be modified.

In some exemplary embodiments, the supporting surface may comprise a third supporting surface segment, arranged between the first supporting surface segment and the second supporting surface segment. The first supporting surface segment and the second supporting surface segment are each mounted pivotably on the third supporting surface segment. In addition, the first supporting surface segment can be pivoted relative to the third supporting surface segment by means of the first pair of hydraulic cylinders. Furthermore, the second supporting surface segment can be pivoted relative to the third supporting surface segment by means of the second pair of hydraulic cylinders. The first supporting surface segment comprises a leg plate, the second supporting surface segment comprises a back plate, and the third supporting surface segment comprises a base plate, also referred to as a seat plate. This enables the back plate and the leg plate to each be flexibly pivoted relative to the base plate of a patient supporting surface.

In some exemplary embodiments, the operating table comprises an electric and/or hydraulic linear drive for displacing the supporting surface in relation to the column in a longitudinal direction of the supporting surface. More particularly, the operating table may comprise an electric linear drive having a gear wheel for displacing the supporting surface in relation to the column in a longitudinal direction of the supporting surface, the gear wheel meshing with a gear rack which is displaced together with the supporting surface in relation to the column when the gear wheel is rotated. The provision of an electric and/or hydraulic linear drive enables a reliable linear longitudinal displacement of the supporting surface in relation to the column.

In some exemplary embodiments, a modular operating table system includes various modules configured for connection to one another. For example, in one embodiment, the modular operating table system includes a support surface module comprising a patient support surface having at least two support segments and valves for connection to a hydraulic system to implement pivoting of the at least two segments of the support surface relative to one another. A column module configured for connection to the support surface module comprises a hydraulic system and connections for a single supply line and a single return line configured to be connected to a valve unit in the support surface module. The column module may be configured to implement lifting, tilting and inclining actions of the support surface. Further, in additional exemplary embodiments, the modular operating table system may include one or more additional modules, such as, for example, one or more of a base module configured to support the column module in a substantially upright position, and a head module coupled with the column module and configured to displace the supporting surface in a longitudinal direction relative to the column module.

Figure 1B:
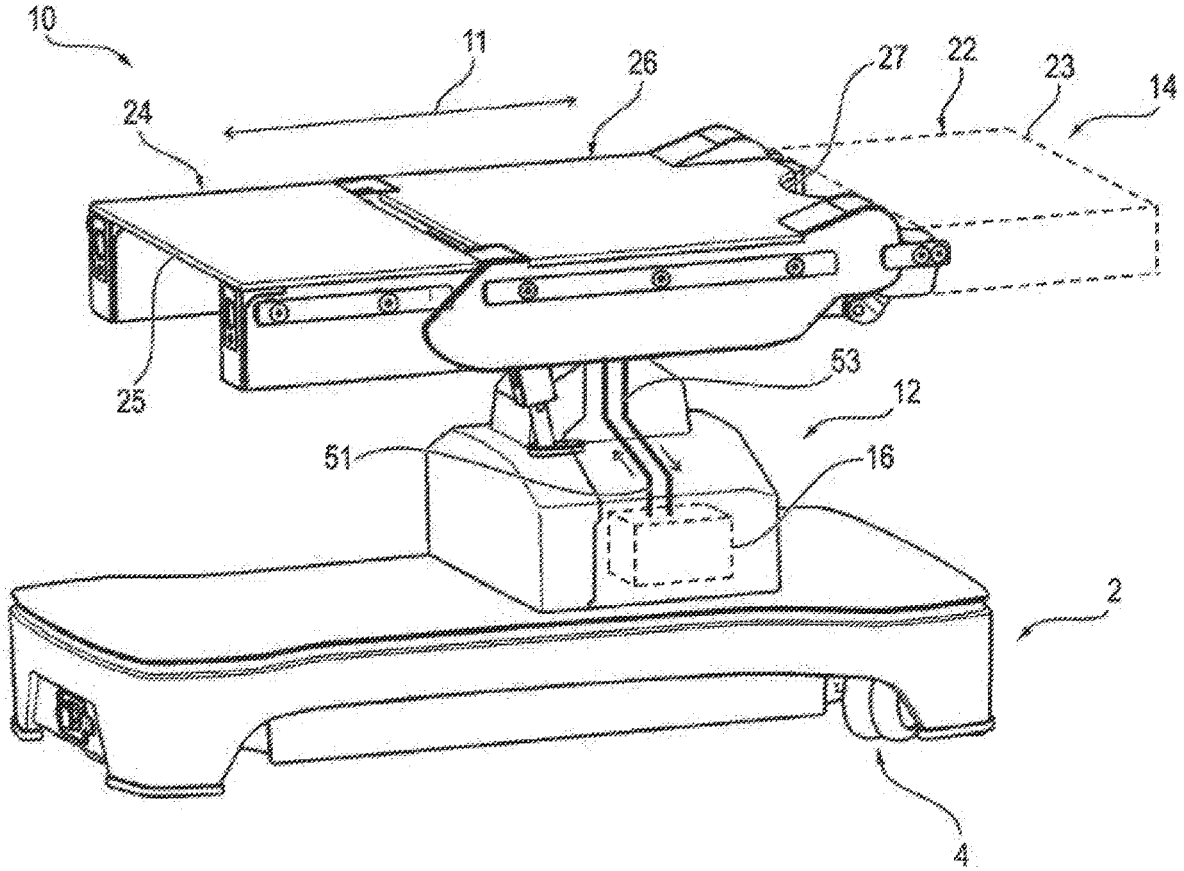
FIG. 1B shows the operating table of FIG. 1A, which additionally has a leg plate adjoining the base plate.

Referring now to the figures, FIG. 1A shows an operating table 10 with a column 12 and a supporting surface 14 connected to the column 12. As shown in FIG. 1A, the supporting surface 14 is connected to the upper end of column 12 such that the height, the tilt, and the inclination of the supporting surface 14 can be adjusted by means of drives that are arranged in column 12. As used herein, "inclination" refers to an orientation of the supporting surface 14 about a transverse axis that extends transversely to a longitudinal direction of the supporting surface 14, and "tilt" refers to an orientation of the supporting surface 14 about a longitudinal axis that extends parallel to the longitudinal direction of the supporting surface 14. The transverse axis and the longitudinal axis may be orthogonal to one another. An inclining movement to adjust the inclination is a movement about the transverse axis that extends transversely to the longitudinal direction of supporting surface 14, and a tilting movement to adjust the tilt is a movement about the longitudinal axis that extends parallel to the longitudinal direction of supporting surface 14. In addition, the lower end of column 12 is fixedly connected to a base 2 of operating table 10. In the exemplary embodiment shown in FIG. 1A, supporting surface 14 comprises two separate supporting surface segments 24, 26, which are mounted pivotably relative to one another. Supporting surface segment 24 comprises a back plate 25, and supporting surface segment 26 comprises a base plate 27. Supporting surface 14 can further comprise an additional supporting surface segment 22 having a leg plate 23, as illustrated in FIG. 1B. Also illustrated schematically in FIG. 1B is a hydraulic unit 16 arranged in column 12 and located behind a column side panel.

In the exemplary embodiment shown in FIG. 1A, supporting surface 14 is fixedly connected to column 12 and cannot be removed. Supporting s face 14 is displaceable in relation to column 12 in the longitudinal direction of supporting surface 14 along a longitudinal displacement path, as indicated by longitudinal displacement arrow 11. Operating table 10 can also comprise a hydraulic unit integrated into base 2 for displacing the supporting surface 14 in the longitudinal direction. As FIG. 1A further shows, base 2 comprises rollers 4, at least two of which are embodied as swivel rollers for moving operating table 10.

FIG. 1B shows the operating table of FIG. 1A, which additionally has a leg plate 23 adjoining base plate 27. FIG. 1B shows a hydraulic supply line 51, also called a pressure line, and a hydraulic return line 53, also called a tank line. In FIG. 1B, the direction in which a hydraulic fluid flows through supply line 51 and return line 53 is indicated in each case by an arrow. In the exemplary embodiment shown in FIG. 1B, supporting surface 14 comprises the supporting surface segment 22 (which may be referred to as a first supporting surface segment 22) with leg plate 23, the supporting surface segment 24 (which may be referred to as a second supporting surface segment 24) with back plate 25, and the supporting surface segment 26 (which may be referred to as a third supporting surface segment 26) with base plate 27. The first supporting surface segment 22 and the second supporting surface segment 24 are each pivotable relative to the third supporting surface segment 26.

Figure 2A:
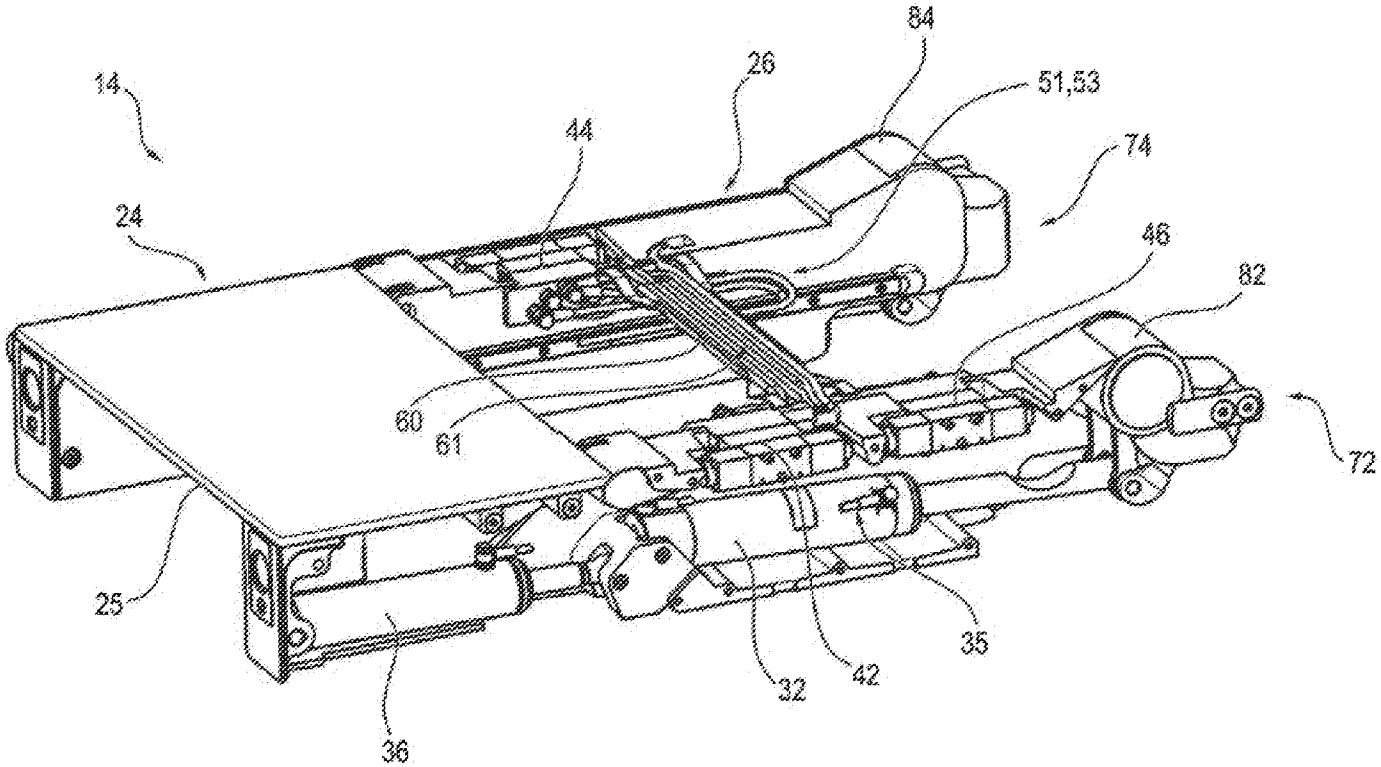
FIG. 2A shows a perspective view of the supporting surface of the operating table of FIG. 1A, with the base plate removed and the side rail opened.

As is illustrated schematically by way of example in FIG. 1B, the hydraulic unit 16 arranged in column 12 does not extend into the area of base 2. FIG. 2A shows a perspective view of supporting surface 14 of the operating table 10 of FIG. 1A, separated from column 12, and with base plate 27 removed. As shown in FIG. 2A, the supporting surface 14 has a first side rail 72 and a second side rail 74 opposite the first side rail 72. The first side rail 72 is shown opened in FIG. A.

In FIG. 2A, a hydraulic cylinder 32 of a first pair of hydraulic cylinders and a hydraulic cylinder 36 of a second pair of hydraulic cylinders are shown. The opposing hydraulic cylinders of the first pair and of the second pair are arranged in the second side rail 74 and are not visible in FIG. 2A. The first pair of hydraulic cylinders is provided for adjusting a first supporting surface segment of supporting surface 14, for example, the first supporting surface segment 22 shown in FIG. 1B and having leg plate 23, and the second pair of hydraulic cylinders is provided for adjusting a second supporting surface segment of supporting surface 14, for example, the second supporting surface segment 24 shown in FIGS. 1A to 2A and having back plate 25. FIG. 2A further illustrates that the hydraulic cylinders 32, 36 have different connections 35 for hydraulic hoses.

The supporting surface 14 shown in FIG. 2A comprises a first valve unit 42, a second valve unit 44, and a third valve unit 46. The first valve unit 42 is integrated into supporting surface 14 and serves to control the first pair of hydraulic cylinders, and the second valve unit 44, integrated into supporting surface 14, serves to control the second pair of hydraulic cylinders. The function of the third valve unit 46 integrated into supporting surface 14 will be explained in greater detail below in reference to FIGS. 4 through 6.

FIG. 2A shows supply line 51 and return line 53. Referring to FIGS. 1B and 2A, the first valve unit 42 and the second valve unit 44 are connected hydraulically to hydraulic unit 16 only via supply line 51 and return line 53.

FIG. 2A shows a cross connection (or crossmember) 60, which extends laterally between the first side rail 72 and the second side rail 74. The cross connection 60 serves to accommodate hoses 61 that extend between the first side rail 72 and the second side rail 74, connecting the valve units (e.g., valve units 42, 44, 46) to the hydraulic cylinders (e.g., hydraulic cylinders 32, 36). The cross connection 60 is preferably fixedly connected to the first side rail 72 and the second side rail 74.

As shown in FIG. 2A, supporting surface 14 comprises leg brackets 82, 84 for attaching supporting surface segment 22, which has leg plate 23 as illustrated in FIG. 1B. The leg brackets 82, 84 are arranged in the two opposing side rails 72, 74.

Figure 2B:
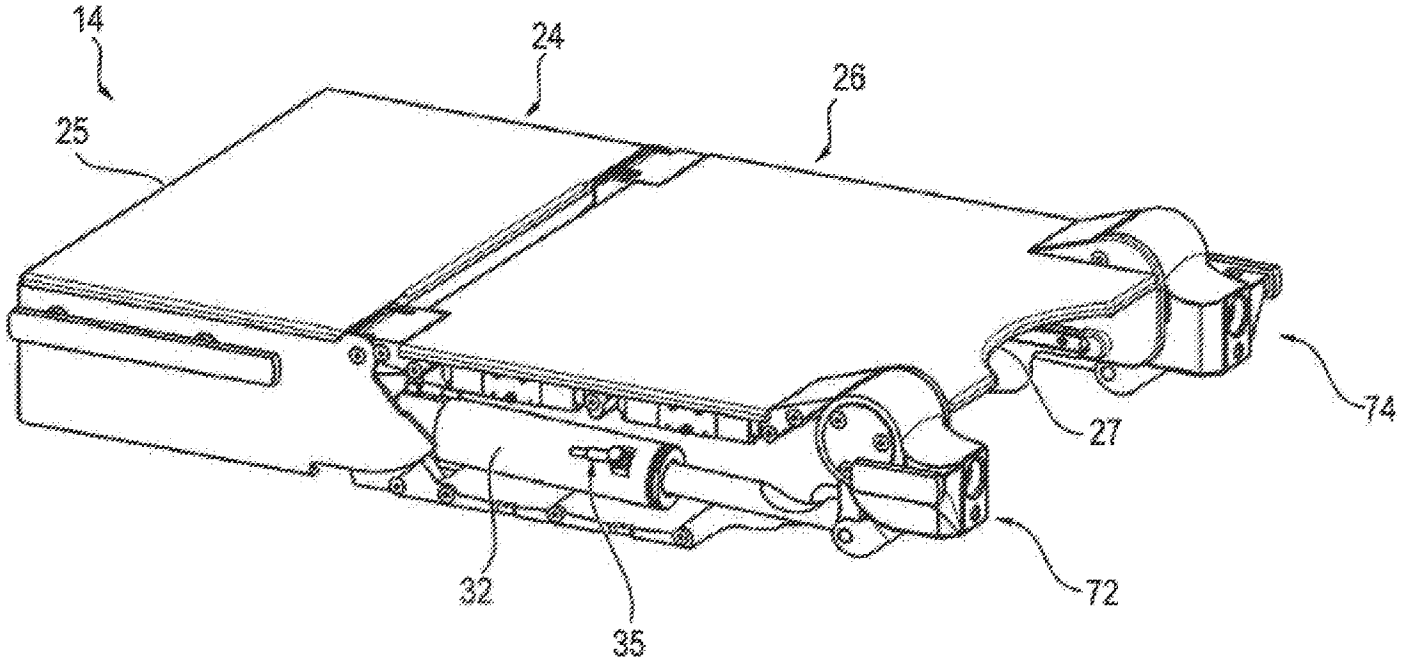
FIG. 2B shows a further perspective view of the supporting surface of the operating table of FIG. 1A with the base plate and the partially opened side rail.

FIG. 2B shows a perspective view of the supporting surface 14 of operating table 10 of FIG. 1A with the base plate 27 and with the side rail 72 partially opened. In FIG. 2B, only hydraulic cylinder 32 is visible, while hydraulic cylinder 36 along with the first, second, and third valve units 42, 44, 46, supply line 51 and return line 53, and cross connection 60, all of which are arranged beneath base plate 27, are not visible.

Figure 3:
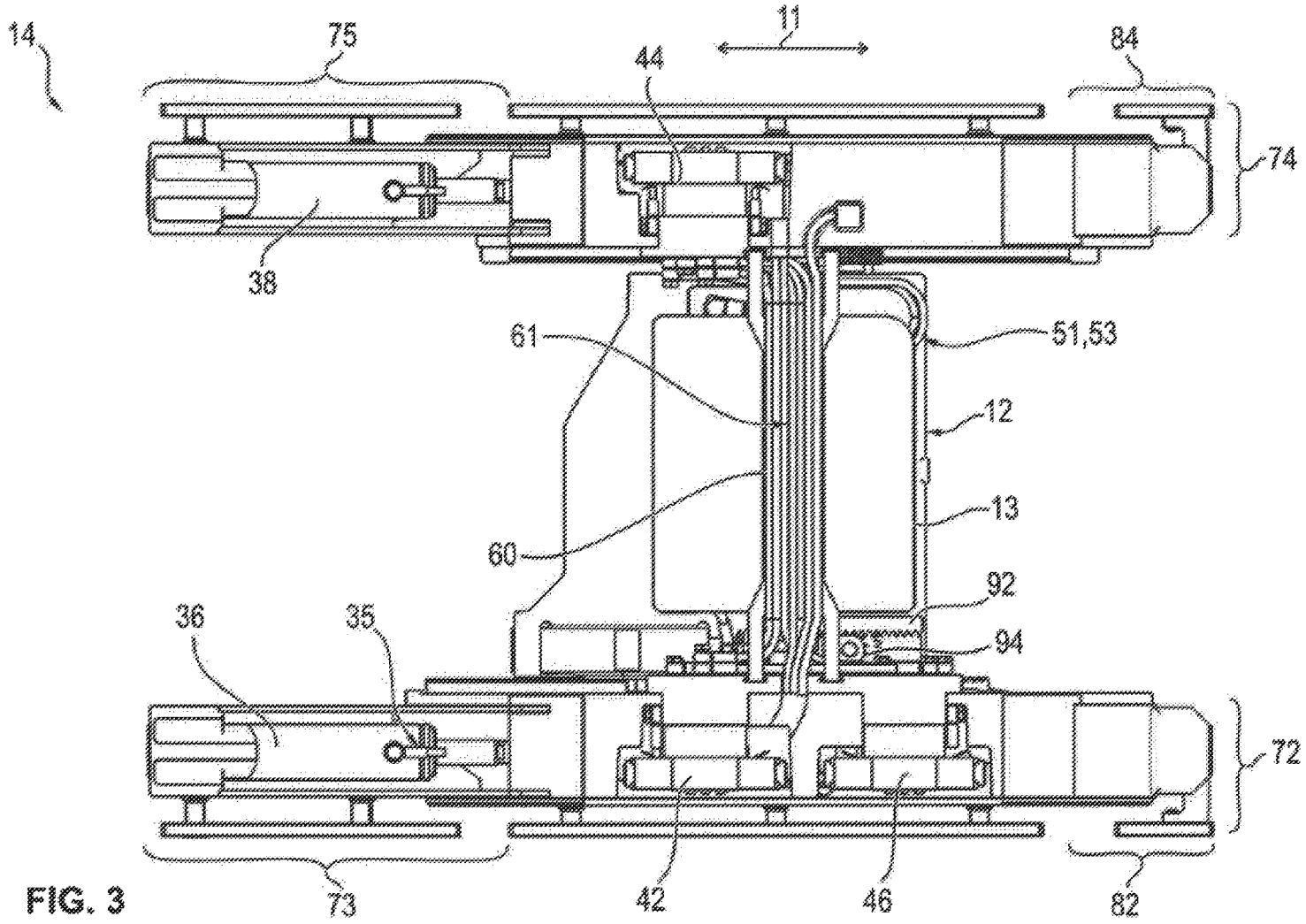
FIG. 3 shows a plan view of the supporting surface of the operating table of FIG. 1A with the back plate hidden and the base plate hidden.

FIG. 3 shows a plan view of supporting surface 14 of operating table 10 of FIG. 1A with back plate 25 hidden and base plate 27 hidden. In the plan view of FIG. 3, the hydraulic cylinders 36, 38 of the second pair, which are arranged in sections 73, 75 of side rails 72, 74 beneath the hidden back plate 25, are visible. Also visible in the plan view of FIG. 3 are the first, second, and third valve units 42, 44, 46, supply line 51 and return line 53, and cross connection 60 with hoses 61.

In FIG. 3, the direction of longitudinal displacement of the supporting surface 14 along a longitudinal displacement path is indicated by longitudinal displacement arrow 11. When the supporting surface 14 is displaced longitudinally, all the components that are integrated into supporting surface 14, in particular cross connection 60, which is fixedly connected to side rails 72, 74, move along with supporting surface 14. Column 12 with the column head 13, shown in FIG. 3, is immovably arranged in this case. As shown in FIG. 3, the supply line 51 and the return line 53 are installed at least partially in an area of the column 12 that faces a longitudinal side of the supporting surface 14, in a compensating loop to compensate for movement of the supporting surface 14 during longitudinal displacement.

As is shown in FIG. 3, operating table 10 comprises an electric linear drive, for example, having a gear wheel 94 for generating the longitudinal displacement. Gear wheel 94 meshes with a gear rack 92, so that when gear wheel 94, which is driven by an electric motor (not shown), is rotated, supporting surface 14 is displaced relative to column 12. Alternatively or additionally, operating table 10 may also comprise a hydraulic linear drive for generating the longitudinal displacement.

Figure 4:
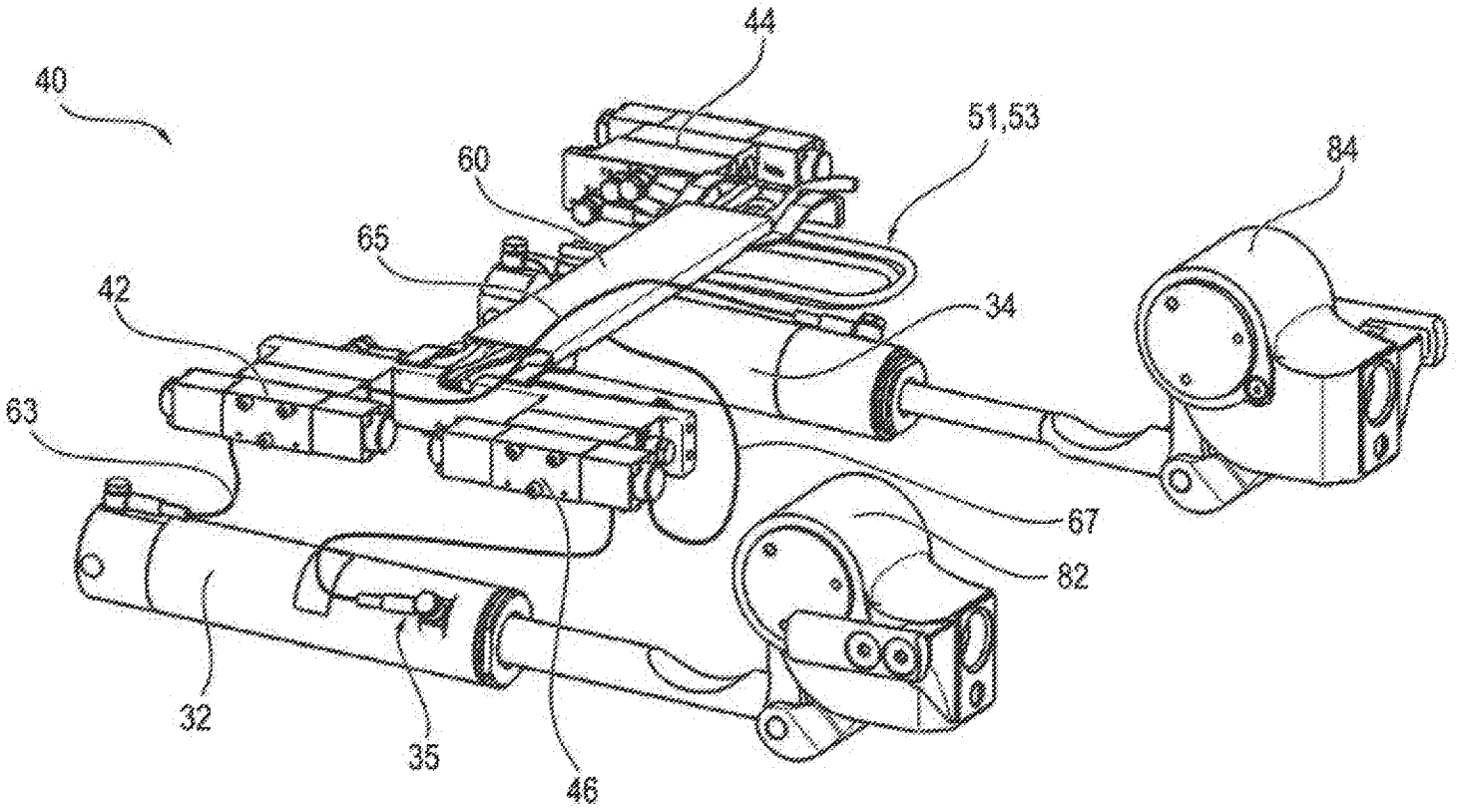
FIG. 4 shows a perspective view of a hydraulic cylinder system according to an embodiment of the disclosure, separated from the supporting surface of FIG. 2A and comprising a first valve unit, a second valve unit and a third valve unit embodied as a synchronizing valve unit.

FIG. 4 shows a perspective view of a hydraulic cylinder system 40 comprising the first valve unit 42, the second valve unit 44 and the third valve unit 46. In the embodiment of FIG. 4, each of the valve units 42, 44, and 46 comprise synchronizing valve units. The hydraulic cylinder system 40 shown in FIG. 4 comprises hydraulic cylinder 32 and hydraulic cylinder 34. As shown in FIG. 4, the hydraulic cylinder system 40 is formed by the first pair of hydraulic cylinders 32, 34. Alternatively or additionally, the second pair of hydraulic cylinders 36, 38 of FIG. 3 may also form a corresponding hydraulic cylinder system.

As is shown in FIG. 4, the first hydraulic cylinder 32 and the second hydraulic cylinder 34 are each connected to the first valve unit 42 via a hose 63, 65. In addition, the first hydraulic cylinder 32 and the second hydraulic cylinder 34 are connected in series via a connecting hose 67. Connecting hose 67 can be connected either to supply line 51 shown in FIG. 1B or to return line 53 shown in FIG. 1B via the third valve unit 46, which, in the exemplary embodiment of FIG. 4, comprises a synchronizing valve unit. Using the hydraulic cylinder system 40 shown in FIG. 4, a clocking or the synchronization of the clocking of the first hydraulic cylinder 32 and the second hydraulic cylinder 34 can be achieved. This will be explained in greater detail below with reference to FIGS. 5 and 6.

Figure 5:
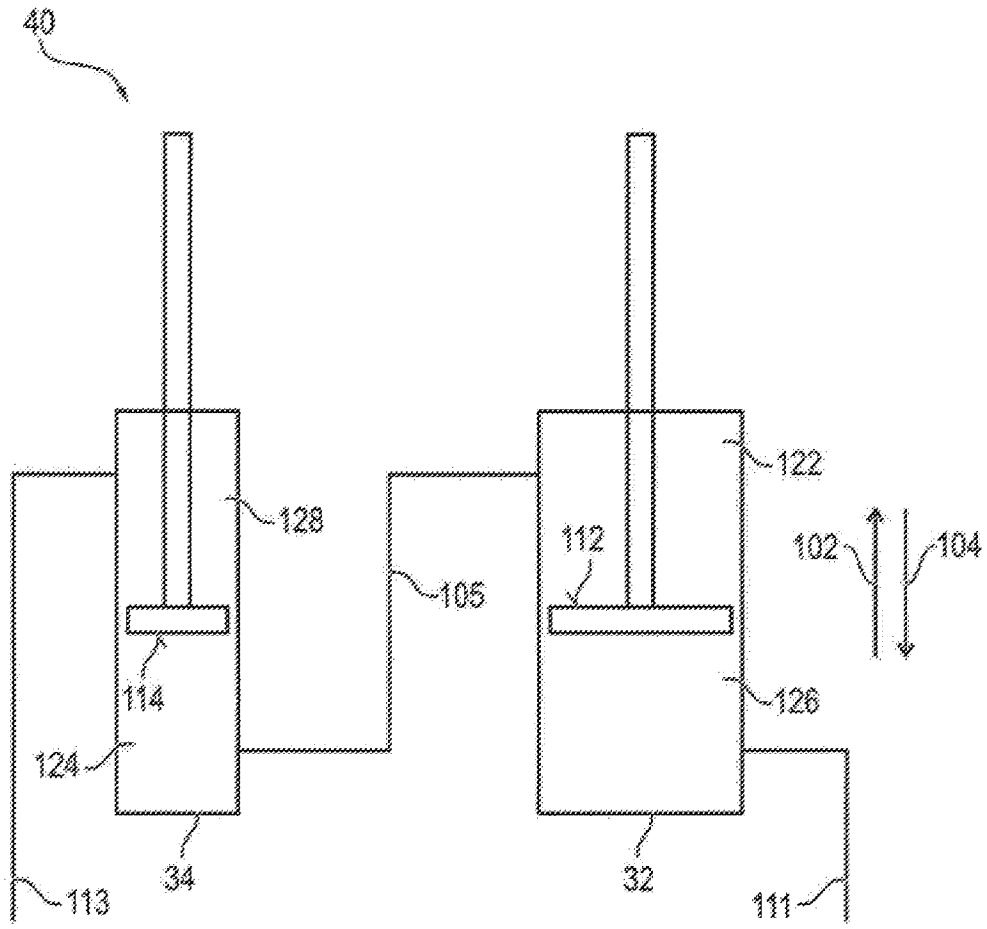
FIG. 5 shows a schematic diagram of a part of the hydraulic cylinder system shown in FIG. 4 with a first hydraulic cylinder and a second hydraulic cylinder.

FIG. 5 shows a schematic diagram of the hydraulic cylinder system 40 shown in FIG. 4, comprising the first hydraulic cylinder 32 and the second hydraulic cylinder 34. As shown in FIG. 5, the first hydraulic cylinder 32 and the second hydraulic cylinder 34 are double-acting hydraulic cylinders having a first piston movement direction 102 and a second piston movement direction 104. The first piston movement direction 102 and the second piston movement direction 104 are opposite one another. In the hydraulic cylinder system 40 shown in FIG. 5, a leading active surface 112 of the first hydraulic cylinder 32 in the first piston movement direction 102 and a leading active surface 114 of the second hydraulic cylinder 34 in the second piston movement direction 104 are the same size (i.e., have the same area). In addition, a cylinder chamber 122 adjoining active surface 112 of the first hydraulic cylinder 32 and a cylinder chamber 124 adjoining active surface 114 of the second hydraulic cylinder 34 are connected to one another via a connecting line 105. Furthermore, a cylinder chamber 126 of the first hydraulic cylinder 32 and a cylinder chamber 124 of the second hydraulic cylinder 34 which are not connected to connecting line 105 are connected to hydraulic lines 111, 113, respectively. Connecting line 105, shown in FIG. 5, comprises the connecting hose 67 shown in FIG. 4, for example, whereas hydraulic lines 111, 113 of FIG. 5 comprise the hoses 63, 65 of FIG. 4, for example. Connecting line 105 shown in FIG. 5 may be referred to as a dead leg.

In the hydraulic cylinder system 40 shown in FIG. 5, the double-acting hydraulic cylinders 32, 34 are each single-rod cylinders, with the active surface 112 of the first hydraulic cylinder 32 being an annular piston surface and the active surface 114 of the second hydraulic cylinder 34 being a circular piston surface. Alternatively, the double-acting hydraulic cylinders 32, 34 may be double-rod cylinders, in which case active surface 112 of the first hydraulic cylinder 32 and active surface 114 of the second hydraulic cylinder 34 are annular piston surfaces of the same size (not shown).

Using the hydraulic cylinder system 40 shown in FIG. 5, the clocking of the two double-acting hydraulic cylinders 32, 34 can be achieved. In addition, with the hydraulic cylinder system 40 shown in FIG. 5, and using the third valve unit 46 shown in FIG. 4 and embodied as a synchronizing valve unit, the clocking of the two double-acting hydraulic cylinders 32, 34 can be synchronized. This will be explained below with reference to the circuit diagram shown in FIG. 6.

Figure 6:
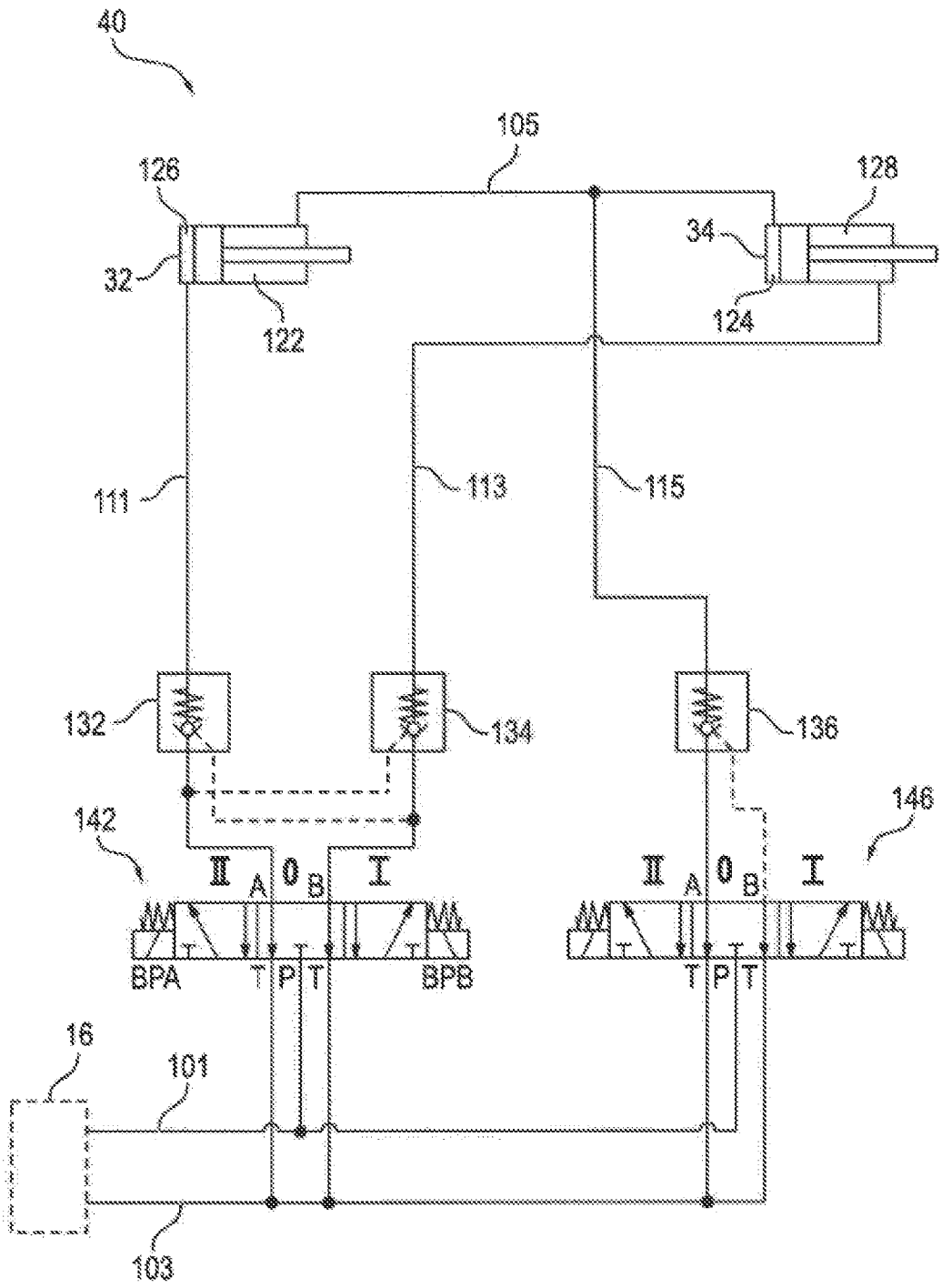
FIG. 6 shows a circuit diagram of the hydraulic cylinder system shown in FIG. 4.

FIG. 6 shows a circuit diagram for the hydraulic cylinder system 40 shown in FIG. 4 and having the first hydraulic cylinder 32 and the second hydraulic cylinder 34. The circuit diagram also comprises a first directional control valve 142 and a second directional control valve 146. The directional control valves 142, 146 shown in FIG. 6 are, for example, 5/3 directional control valves. Furthermore, the first directional control valve 142 with check valves 132, 134 shown in FIG. 6 corresponds substantially to the first valve unit 42 of FIG. 4, and the second directional control valve 146 with the check valve 136 shown in FIG. 6 corresponds substantially to the third valve unit 46 of FIG. 4. To synchronize the clocking of the first hydraulic cylinder 32 and the second hydraulic cylinder 34, in a synchronized operating state connecting line 105 can be connected via the second directional control valve 146 either to a pressure line 101 that is connected to hydraulic unit 16 or to a return flow line 103 that is connected to hydraulic unit 16. For example, the pressure line 101 shown in FIG. 6 corresponds to supply line 51 shown in FIG. 1, and the return flow line 103 shown in FIG. 6 corresponds to return line 53 shown in FIG. 1B.

In the clocked operating state, the piston movements of the first hydraulic cylinder 32 and the second hydraulic cylinder 34 are synchronous. In this state, the second directional control valve 146 is closed, i.e., the connecting line 105 is not connected to either pressure line 101 or return flow line 103.

Hydraulic cylinders 32, 34 are shown with hydraulic lines 111, 113 and a line section 115 of connecting line 105. As is illustrated by way of example in FIG. 6, check valves 132, 134 are arranged in hydraulic lines 111, 113, respectively, while another check valve 136 is arranged in line section 115. Check valves 132, 134 form a double-releasable check valve system, which is arranged between the first directional control valve 142 and the hydraulic cylinders 32, 34. Check valves 132, 134 of the double-releasable check valve system can be hydraulically released in the direction of the respective hydraulic cylinders 32, 34, i.e. in a direction opposite the locking direction. In the embodiment of FIG. 6, check valve 136 is also a releasable check valve, and is arranged between the second directional control valve 146 and the hydraulic cylinder system 40. The releasable check valve 136 can be hydraulically released in the direction of hydraulic cylinder system 40, i.e., in a direction opposite the locking direction. Pressure line 101 is connected to the pressure port of the pump of hydraulic unit 16, and the return flow line 103 is connected to a tank of the hydraulic unit 16.

The functioning of the first directional control valve 142 and of the second directional control valve 146 will be explained below by way of example. When the first directional control valve 142 is in a home position ("0"), the first hydraulic line 111 is connected to return flow line 103 via the first directional control valve 142. Additionally, when the first directional control valve 142 is in the home position ("0"), the second hydraulic line 113 is connected to return flow line 103 via the first directional control valve 142. When the first directional control valve 142 is in the home position ("0"), no hydraulic fluid can flow out of the cylinder chambers 126, 128 of hydraulic cylinders 32, 34 since the double-releasable check valve system with check valves 132, 134 is closed.

When the first directional control valve 142 is in a second position (I), the first hydraulic line 111 is connected to return flow line 103 via the first directional control valve 142. Additionally, when the first directional control valve 142 is in the second position (I), the second hydraulic line 113 is connected to pressure line 101 via the first directional control valve 142. When the first directional control valve 142 is in the second position (I), cylinder chamber 128 of the second hydraulic cylinder 34 can be pressurized via pressure line 101 and the second hydraulic line 113, and the hydraulic fluid can flow out of cylinder chamber 126 of the first hydraulic cylinder 32 via first hydraulic line 111 and return flow line 103.

When the first directional control valve 142 is in a third position (II), the first hydraulic line 111 is connected to pressure line 101 via the first directional control valve 142. Additionally, when the first directional control valve 142 is in the third position (II), the second hydraulic line 113 is connected to return line 103 via the first directional control valve 142. When the first directional control valve 142 is in the third position (II), cylinder chamber 126 of the first hydraulic cylinder 32 can be pressurized via pressure line 101 and the first hydraulic line 111, and the hydraulic fluid can flow out of cylinder chamber 128 of the second hydraulic cylinder 34 via second hydraulic line 113 and return flow line 103.

When the first directional control valve 142 is in the second position (I), the first check valve 132 is released, and when the first directional control valve 142 is in the third position (II), the second check valve 134 is released. Thus, when the first directional control valve 142 is in the second position (I) or the third position (II), the clocking of hydraulic cylinders 32, 34 with the two different piston movement directions 104 and 102 can be achieved. Moreover, when the first directional control valve 142 is in the home position ("0"), hydraulic fluid can be prevented from flowing out of the hydraulic cylinders 32, 34.

When the second directional control valve 146 is in a home position ("0"), line section 115 is connected to return flow line 103 via the second directional control valve 146. When the second directional control valve 146 is in a second position (I), line section 115 is connected to return flow line 103 via the second directional control valve 146. When the second directional control valve 146 is in a third position (II), line section 115 is connected to pressure line 101 via the second directional control valve 146. When the second directional control valve 146 is in the home position ("0"), no hydraulic fluid can flow out via line section 115 and return flow line 103 since check valve 136 is locked. When the second directional control valve 146 is in the second position (I), the hydraulic fluid can flow out of connecting line 105 via line section 115 and return flow line 103 since check valve 136 is released. When the second directional control valve 146 is in the third position (II), connecting line 105 can be pressurized via line section 115 and pressure line 101. Thus, when the second directional control valve 146 is in the second position (I), hydraulic fluid can flow out of connecting line 105, and when it is in the third position (II), connecting line 105 can be pressurized. This enables the clocking of the hydraulic cylinders 32, 34 to be synchronized.

One exemplary procedure for synchronizing the clocking is as follows. First, cylinder chamber 128 of the second hydraulic cylinder 34 is pressurized, while at the same time, the hydraulic fluid flows out of cylinder chamber 126 of the first hydraulic cylinder 32 into return flow line 103. This causes the piston of the second hydraulic cylinder 34 and the piston of the (downstream) first hydraulic cylinder 32 in FIG. 6 to move to the left or in the second piston movement direction 104.

If the volume of hydraulic fluid in connecting line 105 is too great for synchronous piston movements of the first hydraulic cylinder 32 and the second hydraulic cylinder 34, the piston of the first hydraulic cylinder 32 will reach its end stop first, before the piston of the second hydraulic cylinder 34 has reached its end stop. In that case, the third valve unit 46, i.e. the second directional control valve 146, can be controlled in order to allow the hydraulic fluid to flow out of cylinder chamber 124 of the second hydraulic cylinder 34 via connecting line 105 and return flow line 103. In addition, cylinder chamber 128 of the second hydraulic cylinder 34 can continue to be pressurized. In that way, the piston of the second hydraulic cylinder 34 will ultimately also reach its end stop.

If the volume of hydraulic fluid in connecting line 105 is too small for synchronous piston movements of the first hydraulic cylinder 32 and the second hydraulic cylinder 34, the piston of the second hydraulic cylinder 34 will reach its end stop first, before the piston of the first hydraulic cylinder 32 has reached its end stop. In that case, the third valve unit 46 (or the second directional control valve 146) can be controlled in order to allow cylinder chamber 122 of the first hydraulic cylinder 34 to be pressurized via pressure line 101 and connecting line 105. In addition, hydraulic fluid can continue to flow out of cylinder chamber 126 of the first hydraulic cylinder 32. In that way, the piston of the first hydraulic cylinder 32 will ultimately also reach its end stop.

Cylinder chamber 126 of the first hydraulic cylinder 32 or the piston of the first hydraulic cylinder 32 located at the end stop can then be pressurized, while at the same time, hydraulic fluid can flow out of cylinder chamber 128 of the second hydraulic cylinder 34. Moreover, the third valve unit 46 (or the second directional control valve 146) is closed during this time, so that no hydraulic fluid can flow out of connecting line 105. As a result, the piston of the first hydraulic cylinder 32 and the piston of the (downstream) second hydraulic cylinder 34 each move out of their end stops in FIG. 6 toward the right, or in the first piston movement direction 102. A clocking of the hydraulic cylinders 32, 34 in the first piston movement direction 102 can thereby be achieved.

By reversing the above procedure correspondingly, a clocking of the hydraulic cylinders 32, 34 in the second piston movement direction 104 can also be achieved. Thus, the clocking of the hydraulic cylinders 32, 34 (i.e. the two double-acting hydraulic cylinders always move identically) can be synchronized. Furthermore, the afore-mentioned procedure can also be carried out repeatedly.

Operating tables according to various aspects of the present disclosure have the following exemplary advantages over known operating tables. Typically, four hydraulic cylinders are arranged in the supporting surface of a known operating table, two for adjusting the back plate and two for adjusting the leg plate. To supply these cylinders with hydraulic pressure, two hoses per cylinder are typically required, which must be routed from the valves in the column or base of the table up to the cylinders. In known devices, this results in a hose strand of eight hoses, which leads to installation space problems.

In known operating tables, a plurality of valve units and hydraulic hoses are arranged in the column. The hydraulic unit is arranged in the base of the operating table. A hose strand of eight hoses then runs from the valve units in the column into the column head, where the bundle is divided into four hoses for the left side rail and four hoses for the right side rail. This is not desirable because a total of eight hoses must be guided from the column into the side rails of the supporting surface of the known operating table and must be carried along when a patient supporting surface of the known operating table is displaced longitudinally. The known operating table has a further disadvantage in that it is relatively difficult to install the hose bundle consisting of a total of eight hoses in a loop in order to compensate for the travel path of the patient supporting surface when the patient supporting surface is displaced longitudinally.

Exemplary embodiments of the present disclosure provide a hydraulically adjustable supporting surface for an operating table. It is an advantage of the present disclosure that the valves and valve units can be housed directly where they are required, specifically in the side rails 72, 74 of supporting surface 14. For example, one valve is located in each side rail 72, 74, one for actuating the back and one for the leg plate. In addition, a third valve 46 for a leg plate-specific function, for example, for synchronizing the clocking of the hydraulic cylinder system, can be provided in supporting surface 14. Since the cylinders that are actuated by respective valves are arranged both in the first side rail and in the second side rail, it is advantageous to provide hoses 61 between the side rails 72, 74 because the hoses 61 may be located immovably between the rails 72, 74 and move along with a longitudinal displacement actuation of the supporting surface 14. The hydraulic connection between hydraulic unit 16 and supporting surface 14 is achieved by a pressure line 101 and a tank line 103, which are routed into column 12 on one side of the supporting surface 14 in a loop serving as a compensating bend.

Embodiments of the present disclosure make it possible to use the installation space in column 12 for hydraulic unit 16. A hydraulic unit in base 2 can thereby be dispensed with, allowing the base to be shorter in height. In addition, more installation space is available in the base for other modules. Furthermore, the hydraulic unit can be connected to the supporting surface 14 by means of only two hoses (pressure line and tank line). Thus, not only are fewer hose lines required, but additional installation space is available due to the thinner hose bundle. Furthermore, the loop for bridging the longitudinal displacement path 11 can be implemented with only two hoses 101, 103. In contrast, the customary installation of hydraulic lines for bridging the longitudinal displacement path 11 with eight lines is possible only with a high installation space expenditure and installation effort. Furthermore, the teachings of the present disclosure allow the distance between the stop valves and the cylinders to be minimized. The greater the distance between a stop valve and a hydraulic cylinder, the softer the system and the more difficult it is to bleed. The proximity or the short distance between the stop valve and the hydraulic cylinder helps to optimize the system in terms of rigidity.

Furthermore, according to some embodiments of the disclosure, a modular table system can be constructed. For example, hydraulic unit 16 is located in column 12 and, in addition to a motor-pump unit, also includes the valves for actuating the column (e.g. for lifting, tilting and inclining). Additional hydraulic functions of the table can be implemented in the base, for example, for raising the base and extending the driving mechanism, in the column head, in particular for longitudinal displacement, and in the supporting surface for back actuation and leg actuation. In embodiments of the disclosure, the valve technology for the modules of base, column, column head, and supporting surface can be housed separately and in the respective modules. A modular system can thus be used for the development of additional operating tables and table variants, which allows individual functions to be omitted or included, without having to alter the hydraulic system. For example, for a table without a driving mechanism, the valves in the base can be omitted, or for a table without longitudinal displacement, for example, the valve in the column head can be omitted. In such cases, the remainder of the system and the hydraulic unit advantageously remain unchanged. In some embodiments, the base (e.g., base 2 shown in FIGS. 1A and 1B) can simply be eliminated and the column 12 can be attached directly to the floor.

The invention claimed is:

1. An operating table, comprising:

a column;

a hydraulic unit positioned in the column;

a supporting surface connected to the column; and a first pair of hydraulic cylinders for adjusting a portion of the supporting surface relative to a remainder of the supporting surface, wherein the supporting surface is hydraulically connected to the hydraulic unit only by a single supply line and a single return line extending between the supporting surface and the hydraulic unit, and wherein the supporting surface is displaceable relative to the column at least along a longitudinal displacement path in a longitudinal direction of the supporting surface, and the supply line and return line each comprise a hose installed at least partially in a compensation loop for bridging the longitudinal displacement path in an area of the column that faces a longitudinal side of the supporting surface.

2. The operating table of claim 1, wherein the portion of the supporting surface comprises a first supporting surface segment and the remainder of the supporting surface comprises a second supporting surface segment and a third supporting surface segment, the first and second supporting surface segments being pivotably coupled to the third supporting surface segment, and further comprising a second pair of hydraulic cylinders configured to adjust the second supporting surface segment relative to the third supporting surface segment.

3. The operating table of claim 2, wherein a cylinder chamber of a first hydraulic cylinder of the first pair of hydraulic cylinders adjacent a leading active surface of the first hydraulic cylinder and a cylinder chamber of a second hydraulic cylinder of the first pair of hydraulic cylinders adjacent a leading active surface of the second hydraulic cylinder are connected to one another by a connecting line.

4. The operating table of claim 3, further comprising a synchronizing valve unit, wherein the connecting line can be selectively connected either to the single supply line or to the single return line through the synchronizing valve unit.

5. The operating table of claim 4, wherein in a clocked operating state in which the synchronizing valve unit is closed, piston movements of the first and second hydraulic cylinders of the first pair of hydraulic cylinders are synchronous.

6. The operating table of claim 4, further comprising a check valve located between the connecting line and the synchronizing valve unit.

7. The operating table of claim 2, wherein the first pair of hydraulic cylinders comprises a first hydraulic cylinder and a second hydraulic cylinder, wherein the second pair of hydraulic cylinders comprises a third hydraulic cylinder and a fourth hydraulic cylinder, wherein the supporting surface has a first side rail and a second side rail opposite the first side rail, and wherein the first hydraulic cylinder and the third hydraulic cylinder are arranged in the first side rail and the second hydraulic cylinder and the fourth hydraulic cylinder are arranged in the second side rail.

8. The operating table of claim 7, wherein the first hydraulic cylinder and the second hydraulic cylinder are each connected by a first hose to a first valve unit, wherein the third hydraulic cylinder and the fourth hydraulic cylinder are each connected via a second hose to a second valve unit, and wherein the operating table further comprises a crossmember fixedly connected between the first side rail and the second side rail and the first hose and the second hose are routed along the crossmember.

9. The operating table of claim 8, wherein the first valve unit is located in the first side rail and the second valve unit is located in the second side rail.

10. The operating table of claim 1, wherein the supporting surface is displaceable relative to the column in a longitudinal direction of the supporting surface.

11. The operating table of claim 1, wherein the first pair of hydraulic cylinders comprise double-acting hydraulic cylinders with a first piston movement direction and a second piston movement direction.

12. The operating table of claim 1, wherein leading active surfaces of each hydraulic cylinder of the first pair of hydraulic cylinders have a same area.

13. An operating table, comprising:

a column;

a hydraulic unit positioned at least partially within the column; and a supporting surface attached to the column, the supporting surface comprising:

a first segment, a second segment, and a third segment to which the first segment and the second segment are pivotably coupled;

a first pair of hydraulic cylinders for adjusting the first segment relative to the third segment;

a second pair of hydraulic cylinders for adjusting the second segment relative to the third segment;

a first valve unit in fluid communication with the hydraulic unit and the first pair of hydraulic cylinders; and a second valve unit in fluid communication with the hydraulic unit and the second pair of hydraulic cylinders, wherein the first valve unit and the second valve unit are hydraulically connected to the hydraulic unit via a supply line and a return line only.

14. The operating table of claim 13, wherein the first valve unit and the second valve unit are integrated into the supporting surface.

15. The operating table of claim 13, wherein the supply line and the return line extend between the hydraulic unit in the column and the supporting surface.

16. The operating table of claim 13, further comprising a crossmember extending laterally across the supporting surface, and at least one hydraulic line extending along the crossmember between one of the first valve unit and the second valve unit and one of the first pair of hydraulic cylinders and the second pair of hydraulic cylinders.

17. The operating table of claim 16, wherein the crossmember moves with the supporting surface during longitudinal displacement of the supporting surface.

* * * * *